US010253405B2

(12) United States Patent
Kumagai et al.

(10) Patent No.: US 10,253,405 B2
(45) Date of Patent: Apr. 9, 2019

(54) CU—NI—SI-BASED COPPER ALLOY SHEET HAVING EXCELLENT MOLD ABRASION RESISTANCE AND SHEAR WORKABILITY AND METHOD FOR MANUFACTURING SAME

(75) Inventors: Jun-Ichi Kumagai, Aizuwakamatsu (JP); Yoshio Abe, Aizuwakamatsu (JP); Akira Saito, Aizuwakamatsu (JP); Shuzo Umezu, Aizuwakamatsu (JP); Ryo Iino, Aizuwakamatsu (JP)

(73) Assignee: Mitsubishi Shindoh Co., Ltd., Shinagawa-Ku (JP)

( * ) Notice: Subject to any disclaimer, the term of this patent is extended or adjusted under 35 U.S.C. 154(b) by 833 days.

(21) Appl. No.: 14/366,921

(22) PCT Filed: Dec. 22, 2011

(86) PCT No.: PCT/JP2011/079851

§ 371 (c)(1),
(2), (4) Date: Jun. 19, 2014

(87) PCT Pub. No.: WO2013/094061

PCT Pub. Date: Jun. 27, 2013

(65) Prior Publication Data

US 2015/0000803 A1 Jan. 1, 2015

(51) Int. Cl.

| | |
|---|---|
| ***C22C 9/04*** | (2006.01) |
| ***C22F 1/08*** | (2006.01) |
| ***C22C 9/06*** | (2006.01) |
| ***H01B 1/02*** | (2006.01) |

(52) U.S. Cl.

CPC ..... *C22F 1/08* (2013.01); *C22C 9/04* (2013.01); *C22C 9/06* (2013.01); *H01B 1/026* (2013.01)

(58) Field of Classification Search

CPC ..... C22C 9/04

See application file for complete search history.

(56) References Cited

U.S. PATENT DOCUMENTS

2010/0269959 A1 10/2010 Gao et al.

FOREIGN PATENT DOCUMENTS

| | | | |
|---|---|---|---|
| JP | 05-279825 | A | 10/1993 |
| JP | 10-219374 | A | 8/1998 |
| JP | 2005-213611 | A | 8/2005 |
| JP | 2006-152392 | A | 6/2006 |
| JP | 2006-274422 | A | 10/2006 |
| JP | 2007-119844 | A | 5/2007 |
| JP | 2007-119845 | A | 5/2007 |
| JP | 2007-231364 | A | 9/2007 |
| JP | 4006460 | B1 | 11/2007 |
| JP | 4006467 | B1 | 11/2007 |
| JP | 2009-242926 | A | 10/2009 |
| JP | 2010-275622 | A | 12/2010 |
| JP | 2011-117034 | A | 6/2011 |
| JP | 2011-214087 | A | 10/2011 |

OTHER PUBLICATIONS

Extended European Search Report dated Nov. 4, 2015, issued for the corresponding European patent application No. 11878054.3.

International Search Report dated Apr. 10, 2012, issued for PCT/JP2011/079851.

*Primary Examiner* — Christopher S Kessler

(74) *Attorney, Agent, or Firm* — Locke Lord LLP; James E. Armstrong, IV; Nicholas J. DiCeglie, Jr.

(57) ABSTRACT

A Cu—Ni—Si-based copper alloy sheet of the invention has excellent mold abrasion resistance and shear workability while maintaining strength and conductivity, in which 1.0 mass % to 4.0 mass % of Ni is contained, 0.2 mass % to 0.9 mass % of Si is contained, the remainder is made up of Cu and inevitable impurities. The number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, a/b is in a range of 0.5 to 1.5.

16 Claims, No Drawings

CU—NI—SI-BASED COPPER ALLOY SHEET HAVING EXCELLENT MOLD ABRASION RESISTANCE AND SHEAR WORKABILITY AND METHOD FOR MANUFACTURING SAME

TECHNICAL FIELD

The present invention relates to a Cu—Ni—Si-based copper alloy sheet having excellent mold abrasion resistance and shear workability, and a method for manufacturing the same.

BACKGROUND ART

While it is not easy for a Cu—Ni—Si-based copper alloy to have all properties of high strength, high conductivity, and excellent bending workability, generally, the Cu—Ni—Si-based copper alloy is excellent in terms of a variety of characteristics, and is inexpensive, and thus is widely used as a conductive member such as a connector for vehicle electric connection or a connection terminal for a print substrate after a plating treatment is carried out on the surface of the copper alloy to improve the electric connection characteristic and the like. Recently, there has been a demand not only for high strength and high conductivity but also for strict bending workability such as 90° bending after notching.

In addition, the connector for electric connection used in the periphery of the recent vehicle engine is required to have excellent durability (stress relaxation resistance or thermal creep properties) against a deterioration phenomenon of the contact pressure decreasing as time elapses to ensure contact reliability in a high-temperature environment.

In addition, it is usual to manufacture the conductive member such as a connector for vehicle electric connection or a connection terminal for a print substrate by pressing copper or a copper alloy, and a steel material such as dies steel or high-speed steel is used for a press mold. A majority of age-hardenable copper-based alloys such as a Cu—Ni—Si-based copper alloy contain an active element and have a tendency of significantly abrading a press mold compared with generally used phosphor bronze. When a press mold is abraded, burrs or shear drops are generated on a cross-sectional surface of a material to be worked, the deterioration of a worked shape is caused, and the manufacturing cost rises, and thus there is another demand for a Cu—Ni—Si-based copper alloy having excellent mold abrasion resistance and shear workability (press punching properties).

To solve the above-described problems, PTL 1 discloses a copper alloy having excellent press workability in which (1) composition: an element having an oxide standard free energy of formation of −50 kJ/mol or less at room temperature is used as an essential additive element, the content thereof is in a range of 0.1 mass % to 5.0 mass %, the remainder is Cu and inevitable impurities, (2) layer structure: a Cu layer having a thickness in a range of 0.05 μm to 2.00 μm is provided, and the compressive residual stress is 50 N/mm$^2$ or less at a point 1 μm inside from the interface between the Cu layer and a copper-based alloy.

PTL 2 discloses a Corson-based copper alloy sheet in which, when a copper alloy rolled sheet made of a Cu—Ni—Si-based copper alloy is finishing-cold-rolled, the finishing cold rolling is carried out at a working rate of 95% or more before a final solution treatment, the finishing cold rolling is carried out at a working rate of 20% or less after the final solution treatment, then, an aging treatment is carried out so that the average crystal grain diameter in the copper alloy sheet reaches 10 μm or less, the copper alloy sheet has a texture in which the proportion of Cube orientation {001}<100> is 50% or more in the measurement result of an SEM-EBSP method, the copper alloy sheet structure has no lamellar boundary that can be observed in a structure observation using a 300-time optical microscope, the strength is high so as to have a tensile strength of 700 MPa or more, the bending workability is excellent, and the conductivity is also high.

PTL 3 discloses a material for an electronic component which suppresses mold abrasion and has excellent press punching properties in which a copper-based alloy base material containing 0.1 mass % to 5.0 mass % of an element having an oxide standard free energy of formation of −42 kJ/mol or less at 25° C. is coated with a Cu layer in which the total content of components other than S≤500 ppm, 0.5≤S≤50 ppm, the purity of Cu≥99.90%, and the thickness is in a range of 0.05 μm to 2.0 μm.

PTL 4 discloses a Cu—Ni—Si-based copper alloy sheet material having a composition including 0.7 mass % to 4.0 mass % of Ni and 0.2 mass % to 1.5 mass % of Si with a remainder of Cu and inevitable impurities, in which, when the X-ray diffraction intensity of a {200} crystal plane on the sheet surface is represented by I{200}, and the X-ray diffraction intensity of a {200} crystal plane of standard pure copper powder is represented by I0{200}, the crystal orientation satisfies I{200}/I0{200}≥1.0, when the X-ray diffraction intensity of a {422} crystal plane on the sheet surface is represented by I{422}, the crystal orientation satisfies I{200}/I{422}≥15, a high strength of a tensile strength of 700 MPa or more is held, the anisotropy is small, the bending workability is excellent, and the stress relaxation resistance is excellent, and a method for manufacturing the same.

CITATION LIST

Patent Literature

[PTL 1] Japanese Unexamined Patent Application Publication No. 2005-213611

[PTL 2] Japanese Unexamined Patent Application Publication No. 2006-152392

[PTL 3] Japanese Unexamined Patent Application Publication No. 2006-274422

[PTL 4] Japanese Unexamined Patent Application Publication No. 2010-275622

SUMMARY OF INVENTION

Technical Problem

The Cu—Ni—Si-based copper alloy sheets disclosed in the prior art documents are excellent in terms of bending workability, stress relaxation resistance and shear workability respectively, but there has been no sufficient studies regarding a Cu—Ni—Si-based copper alloy sheet having excellent mold abrasion resistance and shear workability while maintaining tensile strength and conductivity.

In consideration of the above-described circumstance, an object of the invention is to provide a Cu—Ni—Si-based copper alloy sheet which has excellent mold abrasion resistance and shear workability while maintaining tensile strength and conductivity and is suitable for use as a conductive member such as a connector for vehicle electric connection or a connection terminal for a print substrate, and a method for manufacturing the same.

Solution to Problem

As a result of thorough studies, the present inventors found that, when 1.0 mass % to 4.0 mass % of Ni is contained, 0.2 mass % to 0.9 mass % of Si is contained, the remainder is made up of Cu and inevitable impurities, the number of Ni—Si precipitate particles having a grain diameter in a range of 20 nm to 80 nm on a surface is in a range of $1.5\times10^6$ particles/mm$^2$ to $5.0\times10^6$ particles/mm$^2$, the number of Ni—Si precipitate particles having a grain diameter of greater than 100 nm on the surface is in a range of $0.5\times10^5$ particles/mm$^2$ to $4.0\times10^5$ particles/mm$^2$, in a case in which the number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, a/b is in a range of 0.5 to 1.5, and the concentration of Si forming a solid solution in crystal grains in a range that is less than 10 μm thick from the surface is in a range of 0.03 mass % to 0.4 mass %, a Cu—Ni—Si-based copper alloy sheet has excellent mold abrasion resistance and shear workability while maintaining tensile strength and conductivity.

That is, a Cu—Ni—Si-based copper alloy sheet of the invention having excellent mold abrasion resistance and shear workability contains 1.0 mass % to 4.0 mass % of Ni and 0.2 mass % to 0.9 mass % of Si with a remainder made up of Cu and inevitable impurities, in which the number of Ni—Si precipitate particles having a grain diameter in a range of 20 nm to 80 nm on a surface is in a range of $1.5\times10^6$ particles/mm$^2$ to $5.0\times10^6$ particles/mm$^2$, the number of Ni—Si precipitate particles having a grain diameter of greater than 100 nm on the surface is in a range of $0.5\times10^5$ particles/mm$^2$ to $4.0\times10^5$ particles/mm$^2$, in a case in which the number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, a/b is in a range of 0.5 to 1.5, and the concentration of Si forming a solid solution in crystal grains in an area that is less than 10 μm thickness from the surface is in a range of 0.03 mass % to 0.4 mass %.

Ni and Si form fine particles of an intermetallic compound mainly containing $Ni_2Si$ when being subjected to an appropriate thermal treatment. As a result, the strength of the alloy significantly increases, and the electric conductivity also increases at the same time.

Ni is added in a range of 1.0 mass % to 4.0 mass %. When the content of Ni is less than 1.0 mass %, it is not possible to obtain a sufficient strength. When the content of Ni exceeds 4.0 mass %, cracking occurs during hot rolling.

Si is added in a range of 0.2 mass % to 0.9 mass %. When the content of Si is less than 0.2 mass %, the strength is decreased. When the content of Si exceeds 4.0 mass %, Si does not contribute to the strength, and the conductivity is decreased due to excessive Si.

When the number of Ni—Si precipitate particles having a grain diameter in a range of 20 nm to 80 nm on the surface is in a range of $1.5\times10^6$ particles/mm$^2$ to $5.0\times10^6$ particles/mm$^2$, it is possible to maintain the strength.

When the number of the Ni—Si precipitate particles is less than $1.5\times10^6$ particles/mm$^2$ or more than $5.0\times10^6$ particles/mm$^2$, it is not possible to maintain the tensile strength.

When the number of Ni—Si precipitate particles having a grain diameter of greater than 100 nm on the surface is in a range of $0.5\times10^5$ particles/mm$^2$ to $4.0\times10^5$ particles/mm$^2$, it is possible to improve the mold abrasion resistance while maintaining the conductivity.

When the number of the Ni—Si precipitate particles is less than $0.5\times10^5$ particles/mm$^2$ or more than $4.0\times10^5$ particles/mm$^2$, the above-described effect cannot be expected, and particularly, the mold abrasion resistance deteriorates.

In a case in which the number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, when a/b is in a range of 0.5 to 1.5, it is possible to improve the mold abrasion resistance.

When a/b is less than 0.5 or more than 1.5, the improvement of the mold abrasion resistance cannot be expected.

When the concentration of Si forming a solid solution in crystal grains in an area that is less than 10 μm thickness from the surface is in a range of 0.03 mass % to 0.4 mass %, it is possible to improve the shear workability.

When the concentration of Si is less than 0.03 mass % or more than 0.4 mass %, the improvement of the shear workability cannot be expected.

In addition, the Cu—Ni—Si-based copper alloy sheet of the invention having excellent mold abrasion resistance and shear workability further contains 0.2 mass % to 0.8 mass % of Sn and 0.3 mass % to 1.5 mass % of Zn.

Sn and Zn have an action that improves the strength and the thermal resistance. Furthermore, Sn has an action that improves the stress relaxation resistance, and Zn has an action that improves the thermal resistance of solder joint. Sn is added in a range of 0.2 mass % to 0.8 mass %, and Zn is added in a range of 0.3 mass % to 1.5 mass %. When the contents of Sn and Zn are below the above-described ranges, the desired effects cannot be obtained, and when the contents are above the above-described ranges, the conductivity decreases.

In addition, the Cu—Ni—Si-based copper alloy sheet of the invention having excellent mold abrasion resistance and shear workability further contains 0.001 mass % to 0.2 mass % of Mg.

While Mg has an action that improves the stress relaxation characteristic and the hot workability, the effects are not developed when the content of Mg is less than 0.001 mass %, and when the content of Mg exceeds 0.2 mass %, the casting property (the degradation of the quality of the casting surface), hot workability and the thermal ablation resistance of a plate degrade.

In addition, the Cu—Ni—Si-based copper alloy sheet of the invention having excellent mold abrasion resistance and shear workability further contains one or more of 0.007 mass % to 0.25 mass % of Fe, 0.001 mass % to 0.2 mass % of P, 0.0001 mass % to 0.001 mass % of C, 0.001 mass % to 0.3 mass % of Cr, and 0.001 mass % to 0.3 mass % of Zr.

Fe has effects that improve the hot rolling property (so as to suppress the occurrence of surface cracking or cracked edges), refine the precipitate compound of Ni and Si, and improve the plate heating adhesion. However, when the content thereof is less than 0.007%, the desired effects cannot be obtained, and on the other hand, when the content thereof exceeds 0.25%, the effect that improves the hot rolling property is saturated, and the conductivity is also adversely influenced. Therefore, the content of Fe is specified in a range of 0.007% to 0.25%.

P has an effect that suppresses the degradation of the spring property caused by bending working. However, when the content thereof is less than 0.001%, the desired effects cannot be obtained, and on the other hand, when the content thereof exceeds 0.2%, the thermal ablation resistance of a solder is significantly degraded. Therefore, the content of P is specified in a range of 0.001% to 0.2%.

C has effects that improve the press punching workability and furthermore refine the precipitate compound of Ni and Si so as to improve the strength of an alloy. However, when the content thereof is less than 0.0001%, the desired effects cannot be obtained, and on the other hand, when the content thereof exceeds 0.001%, the hot workability is adversely influenced, which is not preferable. Therefore, the content of C is specified in a range of 0.0001% to 0.001%.

Cr and Zr have effects that make C easily contained in a Cu alloy through their strong affinity to C, further refine the precipitate compound of Ni and Si so as to improve the strength of an alloy, and further improve the strength through precipitation. However, when the content thereof is less than 0.001%, the effect that improves the strength of an alloy cannot be obtained, and when the content thereof exceeds 0.3%, a large Cr and/or Zr precipitate is generated, the plating property deteriorates, the press punching workability also deteriorates, and furthermore the hot workability is impaired, which is not preferable. Therefore, the contents of Cr and Zr are specified in a range of 0.001% to 0.3% respectively.

In a method for manufacturing the Cu—Ni—Si-based copper alloy sheet of the invention having excellent mold abrasion resistance and shear workability, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

When the cooling is carried out with a cooling start temperature after the end of the final pass of the hot rolling in a range of 350° C. to 450° C., coarse precipitate particles are generated. When the cold rolling before the solution treatment is carried out with an average rolling reduction per pass in a range of 15% to 30% and a total rolling reduction of 70% or more, a state in which the precipitate particles form a solid solution again is obtained through strong rolling. When the solution treatment is carried out at a temperature in a range of 800° C. to 900° C. for 60 seconds to 120 seconds, precipitate particles other than the coarse precipitate particles are made to form a solid solution as much as possible so that (1) the number of Ni—Si precipitate particles having a grain diameter in a range of 20 nm to 80 nm on a surface is set in a range of $1.5\times10^6$ particles/mm$^2$ to $5.0\times10^6$ particles/mm$^2$, (2) the number of Ni—Si precipitate particles having a grain diameter of greater than 100 nm on the surface is set in a range of $0.5\times10^5$ particles/mm$^2$ to $4.0\times10^5$ particles/mm$^2$, (3) in a case in which the number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, a/b is in a range of 0.5 to 1.5. Then, it is possible to obtain excellent mold abrasion resistance while maintaining tensile strength and conductivity.

When any one of the cooling start temperature after the end of the final pass of the hot rolling, the average rolling reduction per pass and the total rolling reduction of the cold rolling before the solution treatment, and the solution treatment fail to be within the above-described numeric value ranges, the copper alloy structure is incapable of satisfying all of (1), (2) and (3).

In a case in which the solution treatment is carried out after the cold rolling is carried out multiple times through an annealing treatment and the like, the cold rolling before the solution treatment refers to the final cold rolling before the solution treatment.

Furthermore, when the aging treatment is carried out at a temperature in a range of 400° C. to 500° C. for 7 hours to 14 hours, the concentration of Si forming a solid solution in crystal grains in an area that is less than 10 μm thickness from the surface is set in a range of 0.03 mass % to 0.4 mass %. Therefore, it is possible to obtain excellent shear workability.

When the aging treatment conditions are not within the above-described ranges, the concentration of Si forming a solid solution in crystal grains in an area that is less than 10 μm thickness from the surface is not within the above-described range.

Advantageous Effects of Invention

According to the invention, a Cu—Ni—Si-based copper alloy sheet which has excellent mold abrasion resistance and shear workability while maintaining tensile strength and conductivity, and a method for manufacturing the same are provided.

DESCRIPTION OF EMBODIMENTS

Hereinafter, an embodiment of the invention will be described.

[the Component Composition of a Copper-Based Alloy Sheet]

(1) A Cu—Ni—Si-based copper alloy sheet of the invention having excellent mold abrasion resistance and shear workability has a composition including 1.0 mass % to 4.0 mass % of Ni and 0.2 mass % to 0.9 mass % of Si with a remainder made up of Cu and inevitable impurities.

Ni and Si form fine particles of an intermetallic compound mainly containing $Ni_2Si$ when being subjected to an appropriate thermal treatment. As a result, the strength of the alloy significantly increases, and the electric conductivity also increases at the same time.

Ni is added in a range of 1.0 mass % to 4.0 mass %. When the content of Ni is less than 1.0 mass %, it is not possible to obtain a sufficient strength. When the content of Ni exceeds 4.0 mass %, cracking occurs during hot rolling.

Si is added in a range of 0.2 mass % to 0.9 mass %. When the content of Si is less than 0.2 mass %, the strength is decreased. When the content of Si exceeds 4.0 mass %, Si does not contribute to the strength, and the conductivity is decreased due to excessive Si.

(2) The Cu—Ni—Si-based copper alloy sheet of the invention having excellent mold abrasion resistance and shear workability further contains 1.0 mass % to 4.0 mass % of Ni, 0.2 mass % to 0.9 mass % of Si, 0.2 mass % to 0.8 mass % of Sn, and 0.3 mass % to 1.5 mass % of Zn.

Sn and Zn have an action that improves the strength and the thermal resistance. Furthermore, Sn has an action that improves the stress relaxation resistance, and Zn has an action that improves the thermal resistance of solder joint. Sn is added in a range of 0.2 mass % to 0.8 mass %, and Zn is added in a range of 0.3 mass % to 1.5 mass %. When the contents of Sn and Zn are below the above-described ranges, the desired effects cannot be obtained, and when the contents are above the above-described ranges, the conductivity decreases.

(3) The Cu—Ni—Si-based copper alloy sheet of the invention having excellent mold abrasion resistance and shear workability further contains 1.0 mass % to 4.0 mass % of Ni, 0.2 mass % to 0.9 mass % of Si and 0.001 mass % to 0.2 mass % of Mg or 1.0 mass % to 4.0 mass % of Ni, 0.2 mass % to 0.9 mass % of Si, 0.2 mass % to 0.8 mass % of Sn, 0.3 mass % to 1.5 mass % of Zn, and 0.001 mass % to 0.2 mass % of Mg.

While Mg has an effect that improves the stress relaxation characteristic and the hot workability, the effects are not developed when the content of Mg is less than 0.001 mass %, and when the content of Mg exceeds 0.2 mass %, the casting property (the degradation of the quality of the casting surface), hot workability and the thermal ablation resistance of a plate degrade.

The Cu—Ni—Si-based copper alloy sheet of the invention having excellent mold abrasion resistance and shear workability further contains, in addition to the components of (1), (2) or (3), one or more of 0.007 mass % to 0.25 mass % of Fe, 0.001 mass % to 0.2 mass % of P, 0.0001 mass % to 0.001 mass % of C, 0.001 mass % to 0.3 mass % of Cr, and 0.001 mass % to 0.3 mass % of Zr.

Fe has effects that improve the hot rolling property (so as to suppress the occurrence of surface cracking or cracked edges), refine the precipitate compound of Ni and Si, and improve the plate heating adhesion. However, when the content thereof is less than 0.007%, the desired effects cannot be obtained, and on the other hand, when the content thereof exceeds 0.25%, the effect that improves the hot rolling property is saturated, and the conductivity is also adversely influenced. Therefore, the content of Fe is specified in a range of 0.007% to 0.25%.

P has an effect that suppresses the degradation of the spring property caused by bending working. However, when the content thereof is less than 0.001%, the desired effects cannot be obtained, and on the other hand, when the content thereof exceeds 0.2%, the thermal ablation resistance of a solder is significantly degraded. Therefore, the content of P is specified in a range of 0.001% to 0.2%.

C has effects that improve the press punching workability and furthermore refine the precipitate compound of Ni and Si so as to improve the strength of an alloy. However, when the content thereof is less than 0.0001%, the desired effects cannot be obtained, and on the other hand, when the content thereof exceeds 0.001%, the hot workability is adversely influenced, which is not preferable. Therefore, the content of C is specified in a range of 0.0001% to 0.001%.

Cr and Zr have effects that make C easily contained in a Cu alloy through their strong affinity to C, further refine the precipitate compound of Ni and Si so as to improve the strength of an alloy, and further improve the strength through precipitation. However, when the content thereof is less than 0.001%, the effect that improves the strength of an alloy cannot be obtained, and when the content thereof exceeds 0.3%, a large Cr and/or Zr precipitate is generated, the plating property deteriorates, the press punching workability deteriorates, and furthermore the hot workability is impaired, which is not preferable. Therefore, the contents of Cr and Zr are specified in a range of 0.001% to 0.3% respectively.

Furthermore, in the Cu—Ni—Si-based copper alloy sheet of the invention having excellent mold abrasion resistance and shear workability, the number of Ni—Si precipitate particles having a grain diameter in a range of 20 nm to 80 nm on a surface is in a range of $1.5\times10^6$ particles/mm$^2$ to $5.0\times10^6$ particles/mm$^2$, the number of Ni—Si precipitate particles having a grain diameter of greater than 100 nm on the surface is in a range of $0.5\times10^5$ particles/mm$^2$ to $4.0\times10^5$ particles/mm$^2$, in a case in which the number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, a/b is in a range of 0.5 to 1.5, and the concentration of Si forming a solid solution in crystal grains in an area that is less than 10 μm thickness from the surface is in a range of 0.03 mass % to 0.4 mass %.

[the Number of the Ni—Si Precipitate Particles and the Concentration of Si]

In the invention, the number of the Ni—Si precipitate particles per square micrometer in the surface, the surface layer or the portion below the surface layer of the copper alloy sheet were obtained in the following manner.

After being immersed in 10% sulfuric acid for ten minutes as a pretreatment, a 10 mm×10 mm×0.3 mm specimen was washed using water, hit by air blow so as to scatter water, and then a surface treatment was carried out using a flat trimming (ion milling) apparatus manufactured by Hitachi High-Technologies Corporation at an acceleration voltage of 5 kV, an incident angle of 5° and a radiation time of one hour.

Next, the surface of the specimen was observed using a field emission scanning electron microscope S-4800 manufactured by Hitachi High-Technologies Corporation at a magnification of 20000 times, the number of the Ni—Si precipitate particles having a grain diameter in a range of 20 nm to 80 nm in 100 μm$^2$ and the number of the Ni—Si precipitate particles having a grain diameter of more than 100 nm in 100 μm$^2$ were counted, and were converted to the number of particles per square millimeter. The measurement was carried out ten times at changed measurement positions, and the average value was used as the number of the Ni—Si precipitate particles.

Next, the surface layer (a point at a depth of 20% of the entire sheet thickness from the surface in the thickness direction) and the portion below the surface layer were observed, the number of the Ni—Si precipitate particles having a grain diameter in a range of 20 nm to 80 nm in 100 μm$^2$ were counted, and were converted to the number of particles per square millimeter. The measurement was carried out ten times at changed measurement positions, and the average value was used as the number of the Ni—Si precipitate particles.

From the above-described results, the number of the Ni—Si precipitate particles having a grain diameter in a range of 20 nm to 80 nm in the surface layer that was as thick as 20% of the entire sheet thickness from the surface was represented by a particles/mm$^2$, the number of the Ni—Si precipitate particles having a grain diameter in a range of 20 nm to 80 nm in the portion below the surface layer was represented by b particles/mm$^2$, and the a/b was obtained.

In the invention, the concentration of Si forming a solid solution in crystal grains in a crystal structure in a thickness range of less than 10 μm from the surface was obtained in the following manner.

The concentration of Si forming a solid solution in crystal grains at a point 8 μm deep from the surface on a cross section of the specimen perpendicular to the rolling direction was observed using a transmission electron microscope JEM-2010F manufactured by JEOL Ltd. at a magnification of 50000 times. The measurement was carried out ten times at changed measurement positions, and the average value was used as the concentration of Si.

[Method for Manufacturing the Copper-Based Alloy Sheet]

In a method for manufacturing the Cu—Ni—Si-based copper alloy sheet of the invention having excellent mold abrasion resistance and shear workability, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

When the cooling is carried out with a cooling start temperature after the end of the final pass of the hot rolling in a range of 350° C. to 450° C., coarse precipitate particles are generated. When the cold rolling before the solution treatment is carried out with an average rolling reduction per pass in a range of 15% to 30% and a total rolling reduction of 70% or more, a state in which the precipitate particles form a solid solution again is obtained through strong rolling. When the solution treatment is carried out at a temperature in a range of 800° C. to 900° C. for 60 seconds to 120 seconds, precipitate particles other than the coarse precipitate particles are made to form a solid solution as much as possible so that (1) the number of Ni—Si precipitate particles having a grain diameter in a range of 20 nm to 80 nm on a surface is set in a range of $1.5\times10^6$ particles/mm$^2$ to $5.0\times10^6$ particles/mm$^2$, (2) the number of Ni—Si precipitate particles having a grain diameter of greater than 100 nm on the surface is set in a range of $0.5\times10^5$ particles/mm$^2$ to $4.0\times10^5$ particles/mm$^2$, (3) in a case in which the number of the Ni—Si precipitate particles having a grain diameter in a range of 20 nm to 80 nm in a surface layer that is as thick as 20% of the entire sheet thickness from the surface is represented by a particles/mm$^2$, and the number of the Ni—Si precipitate particles having a grain diameter in a range of 20 nm to 80 nm in a portion below the surface layer is represented by b particles/mm$^2$, a/b is in a range of 0.5 to 1.5. Then, it is possible to obtain excellent mold abrasion resistance while maintaining tensile strength and conductivity.

When any one of the cooling start temperature after the end of the final pass of the hot rolling, the average rolling reduction per pass and the total rolling reduction of the cold rolling before the solution treatment, and the solution treatment fail to be within the above-described numeric value ranges, the copper alloy structure is incapable of satisfying all of (1), (2) and (3).

Furthermore, when the aging treatment is carried out at a temperature in a range of 400° C. to 500° C. for 7 hours to 14 hours, the concentrations of Si forming a solid solution in crystal grains in areas that are less than 10 μm thickness from both surfaces of the rolled sheet is set in a range of 0.03 mass % to 0.4 mass %. Therefore, it is possible to obtain excellent shear workability.

When the aging treatment conditions are not within the above-described ranges, the concentrations of Si forming a solid solution in crystal grains in areas that are less than 10 μm thickness from both surfaces of the rolled sheet is not within the above-described range.

A specific example of the manufacturing method is as described below.

First, a material was prepared so as to be capable of producing the Cu—Ni—Si-based copper alloy sheet of the invention, melting and casting were carried out using a low-frequency melting furnace having a reducing atmosphere, thereby obtaining a copper alloy ingot. Next, the copper alloy ingot was heated to a temperature in a range of 900° C. to 980° C., and then hot-rolled so as to produce a hot-rolled sheet having an appropriate thickness. The cooling start temperature after the end of the final pass of the hot rolling was set in a range of 350° C. to 450° C., the hot-rolled sheet was cooled using water, and both surfaces were faced to an appropriate extent.

Next, the cold rolling was carried out with a rolling reduction in a range of 60% to 90% so as to produce a cold-rolled sheet having an appropriate thickness, and continuous annealing was carried out under conditions in which the cold-rolled sheet was held at a temperature in a range of 710° C. to 750° C. for 7 seconds to 15 seconds. The cold-rolled sheet was pickled, surface polishing was carried out, and then the cold rolling was carried out with an average rolling reduction per pass in a range of 15% to 30% and a total rolling reduction of 70% or more, thereby producing a cold-rolled thin sheet having an appropriate thickness.

Next, the solution treatment was carried out on the cold-rolled thin sheet at a temperature in a range of 800° C. to 900° C. for 60 seconds to 120 seconds, then, the aging treatment was carried out at a temperature in a range of 400° C. to 500° C. for 7 hours to 14 hours, a pickling treatment was carried out, furthermore, the final cold rolling was carried out with a workability in a range of 10% to 30%, and the stress-relieving annealing was carried out if necessary.

EXAMPLES

A material was prepared so as to be capable of producing the components described in Table 1, and the material was melted and then cast using a low-frequency melting furnace having a reducing atmosphere, thereby manufacturing a copper alloy ingot having dimensions of a thickness of 80 mm, a width of 200 mm and a length of 800 mm. After the copper alloy ingot was heated to a temperature in a range of 900° C. to 980° C., hot rolling was carried out with the cooling start temperature after the end of the final pass of the hot rolling changed as described in Table 1 so as to produce a hot-rolled sheet having a thickness of 11 mm, the hot-rolled sheet was cooled using water, and then both surfaces were 0.5 mm-faced. Next, cold rolling is carried out with a rolling reduction of 87% so as to produce a cold-rolled thin sheet, continuous annealing in which the cold-rolled thin sheet was held at a temperature in a range of 710° C. to 750° C. for 7 seconds to 15 seconds was carried out. Subsequently, the cold-rolled thin sheet was pickled, surface polishing was carried out, and furthermore, cold rolling was carried out with the average rolling reduction per pass and the total rolling reduction changed as described in Table 1, thereby producing a cold-rolled thin sheet having a thickness of 0.3 mm.

A solution treatment was carried out on the cold-rolled sheet with the temperature and the time changed as described in Table 1, subsequently, an aging treatment was carried out with the temperature and the time changed as described in Table 1, a pickling treatment was carried out, and final cold rolling was carried out, thereby producing thin copper alloy sheets of Examples 1 to 11 and Comparative Examples 1 to 9.

trimming (ion milling) apparatus manufactured by Hitachi High-Technologies Corporation at an acceleration voltage of 5 kV, an incident angle of 5° and a radiation time of one hour.

Next, the surface of the specimen was observed using a field emission scanning electron microscope S-4800 manufactured by Hitachi High-Technologies Corporation at a magnification of 20000 times, the number of the Ni—Si precipitate particles having a grain diameter in a range of 20 nm to 80 nm in 100 $\mu m^2$ and the number of the Ni—Si precipitate particles having a grain diameter of more than 100 nm in 100 $\mu m^2$ were counted, and were converted to the number of particles per square millimeter. The measurement was carried out ten times at changed measurement positions, and the average value was used as the number of the Ni—Si precipitate particles.

TABLE 1

| | Component composition (mass %) | | | | | | | | | | Hot rolling Cooling start temperature | Cold rolling | | Solution treatment | | Aging treatment | |
|---|---|---|---|---|---|---|---|---|---|---|---|---|---|---|---|---|---|
| | | | | | | | | | | | | Average rolling reduction | Total rolling reduction | Temperature | Time | Temperature | Time |
| Cu alloy | Ni | Si | Sn | Zn | Mg | Fe | P | C | Cr | Zr | (° C.) | (%) per pass | (%) | (° C.) | (S) | (° C.) | (H) |
| Example 1 | 1.9 | 0.4 | 0.5 | 1.1 | | | | | | | 450 | 18 | 75 | 850 | 90 | 450 | 8 |
| Example 2 | 2.0 | 0.5 | 0.4 | 0.9 | | 0.03 | 0.01 | | | | 350 | 26 | 80 | 900 | 60 | 400 | 14 |
| Example 3 | 1.6 | 0.3 | 0.5 | 0.3 | 0.005 | | | | | | 400 | 21 | 85 | 850 | 120 | 500 | 7 |
| Example 4 | 3.0 | 0.7 | 0.3 | 1.3 | 0.12 | | | 0.0006 | 0.007 | 0.007 | 400 | 30 | 80 | 800 | 90 | 500 | 10 |
| Example 5 | 1.0 | 0.2 | 0.7 | 0.8 | 0.001 | | | | | | 450 | 20 | 70 | 850 | 120 | 400 | 8 |
| Example 6 | 1.9 | 0.4 | | | | 0.02 | | | | | 350 | 22 | 90 | 900 | 100 | 450 | 7 |
| Example 7 | 1.9 | 0.4 | | | 0.12 | | | | | | 400 | 25 | 80 | 850 | 110 | 480 | 8 |
| Example 8 | 1.9 | 0.4 | | | | | | | | | 450 | 25 | 75 | 800 | 100 | 450 | 8 |
| Example 9 | 1.2 | 0.3 | 0.6 | 1.5 | 0.003 | 0.18 | 0.07 | | | | 400 | 15 | 80 | 850 | 90 | 450 | 7 |
| Example 10 | 3.8 | 0.8 | | | 0.19 | 0.07 | 0.02 | | | | 350 | 18 | 85 | 900 | 60 | 500 | 8 |
| Example 11 | 2.8 | 0.7 | | | 0.015 | | | | | | 450 | 20 | 80 | 800 | 90 | 450 | 8 |
| Comparative Example 1 | 2.1 | 0.6 | 0.5 | 1.0 | 0.004 | | | | | | 600 | 13 | 65 | 950 | 150 | 450 | 20 |
| Comparative Example 2 | 2.8 | 0.6 | 0.4 | 0.7 | | | | | | | 650 | 10 | 60 | 750 | 180 | 400 | 20 |
| Comparative Example 3 | 1.6 | 0.5 | 0.4 | 1.0 | 0.003 | | | | | | 700 | 12 | 60 | 750 | 30 | 550 | 4 |
| Comparative Example 4 | 2.3 | 0.7 | 1.1 | 0.1 | 0.0005 | | | | | | 600 | 8 | 55 | 950 | 30 | 500 | 5 |
| Comparative Example 5 | 4.4 | 1.1 | 1.0 | 0.5 | | | | | | | 650 | 14 | 65 | 700 | 150 | 500 | 7 |
| Comparative Example 6 | 0.7 | 0.1 | 0.1 | 0.5 | | | | | | | 600 | 12 | 60 | 750 | 30 | 500 | 4 |
| Comparative Example 7 | 2.0 | 0.6 | 1.0 | 1.9 | 0.05 | | | | | | 550 | 12 | 60 | 750 | 150 | 550 | 6 |
| Comparative Example 8 | 4.6 | 1.2 | 0.1 | 0.1 | | | | | | | 650 | 10 | 65 | 800 | 150 | 450 | 5 |
| Comparative Example 9 | 4.8 | 1.5 | | | | | | | | | 600 | 12 | 55 | 750 | 120 | 400 | 15 |

Next, for specimens obtained from the respective thin copper alloy sheets, the number of the Ni—Si precipitate particles per square micrometer in the surface, the surface layer or the portion below the surface layer of the copper alloy sheet and the concentration (mass %) of Si forming a solid solution in crystal grains in a thickness range of less than 10 μm from the surface were measured.

The number of the Ni—Si precipitate particles per square micrometer in the surface, the surface layer or the portion below the surface layer of the copper alloy sheet were obtained in the following manner.

After being immersed in 10% sulfuric acid for ten minutes as a pretreatment, a 10 mm×10 mm×0.3 mm specimen was washed using water, hit by air blow so as to scatter water, and then a surface treatment was carried out using a flat Next, the surface layer (a point at a depth of 20% of the entire sheet thickness from the surface in the thickness direction) and the portion below the surface layer were observed, the number of the Ni—Si precipitate particles having a grain diameter in a range of 20 nm to 80 nm in 100 $\mu m^2$ were counted, and were converted to the number of particles per square millimeter.

The measurement was carried out ten times at changed measurement positions, and the average value was used as the number of the Ni—Si precipitate particles.

From the above-described results, the number of the Ni—Si precipitate particles having a grain diameter in a range of 20 nm to 80 nm in the surface layer that was as thick as 20% of the entire sheet thickness from the surface is represented by a particles/$mm^2$, the number of the Ni—Si precipitate particles having a grain diameter in a range of 20 nm to 80 nm in the portion below the surface layer was represented by b particles/mm$^2$, and the a/b was obtained.

In the crystal structure in a thickness range of less than 10 μm from the surface, the concentration of Si forming a solid solution in crystal grains was obtained in the following manner.

The concentration of Si forming a solid solution in crystal grains at a point 8 μm deep from the surface on a cross section of the specimen perpendicular to the rolling direction was observed using a transmission electron microscope JEM-2010F manufactured by JEOL Ltd. at a magnification of 50000 times. The measurement was carried out ten times at changed measurement positions, and the average value was used as the concentration of Si.

The results are described in Table 2.

Next, for specimens obtained from the respective thin copper alloy sheets, the tensile strength, the conductivity, the shear workability and the mold abrasion resistance were measured.

The tensile strength was measured using a JIS No. 5 test specimen.

The conductivity was measured based on JIS-H0505.

Regarding the mold abrasion resistance, the shear stress was measured by carrying out a shear working test with a round punch shape having a diameter of 10 mmϕ, a clearance of 5% and a shear rate of 25 mm/min using a 4204-type universal material test manufactured by Instron Japan Co., Ltd. according to the test method of the Japan Copper and Brass Association technical standard JCBA T310, and the shear resistivity (the shear stress of a material/the tensile strength of the material) was computed. It is assumed that the mold abrasion resistance improves as the shear resistivity decreases.

The shear workability was evaluated using the length of a burr during the shearing of a material, and a shear working test was carried out with a round punch shape having a diameter of 10 mmϕ, a clearance of 5% and a shear rate of 25 mm/min using a 4204-type universal material test manufactured by Instron Japan Co., Ltd. according to the test method of the Japan Copper and Brass Association technical standard JCBA T310. Regarding the length of a burr, the lengths of burrs were measured at four positions present at 90° intervals in the circumferential direction of a punched test specimen, and the average value of the measured values was used as the length of a burr.

The results are described in Table 2.

TABLE 2

| Cu alloy | 20 nm to 80 nm $Ni_2Si$ precipitate (×10$^6$ particles/mm$^2$) | 100 nm or more $Ni_2Si$ precipitate (×10$^5$ particles/mm$^2$) | a/b | Si concentration in crystal grains (mass %) | Tensile strength (N/mm$^2$) | Conductivity (% IACS) | Shear stress (N/mm$^2$) | Mold abrasion resistance (shear stress/ tensile strength) | Shear workability and burr length (mm) |
|---|---|---|---|---|---|---|---|---|---|
| Example 1 | 2.24 | 2.71 | 0.72 | 0.22 | 682 | 41 | 512 | 75 | 0.018 |
| Example 2 | 2.70 | 1.84 | 1.41 | 0.30 | 673 | 42 | 518 | 77 | 0.021 |
| Example 3 | 2.32 | 3.53 | 1.24 | 0.17 | 626 | 45 | 476 | 76 | 0.013 |
| Example 4 | 3.98 | 3.82 | 0.92 | 0.35 | 776 | 41 | 598 | 77 | 0.022 |
| Example 5 | 1.86 | 0.95 | 0.87 | 0.08 | 684 | 44 | 513 | 75 | 0.019 |
| Example 6 | 2.10 | 2.90 | 1.08 | 0.26 | 659 | 43 | 514 | 78 | 0.020 |
| Example 7 | 2.35 | 3.11 | 1.10 | 0.22 | 670 | 42 | 510 | 75 | 0.021 |
| Example 8 | 2.40 | 3.49 | 1.33 | 0.16 | 678 | 41 | 502 | 74 | 0.024 |
| Example 9 | 1.92 | 2.72 | 0.72 | 0.11 | 592 | 43 | 450 | 76 | 0.021 |
| Example 10 | 4.22 | 3.61 | 0.81 | 0.32 | 824 | 40 | 626 | 76 | 0.017 |
| Example 11 | 3.64 | 2.58 | 1.22 | 0.29 | 783 | 42 | 603 | 77 | 0.021 |
| Comparative Example 1 | 5.72 | 0.21 | 1.62 | 0.48 | 616 | 39 | 505 | 82 | 0.033 |
| Comparative Example 2 | 0.85 | 0.35 | 1.70 | 0.52 | 613 | 34 | 509 | 83 | 0.035 |
| Comparative Example 3 | 1.32 | 0.42 | 1.74 | 0.43 | 458 | 36 | 371 | 81 | 0.029 |
| Comparative Example 4 | 5.94 | 0.24 | 1.70 | 0.45 | 679 | 40 | 557 | 82 | 0.031 |
| Comparative Example 5 | 0.79 | 0.33 | 1.60 | 0.78 | 574 | 34 | 488 | 85 | 0.037 |
| Comparative Example 6 | 1.04 | 0.36 | 1.68 | 0.02 | 528 | 35 | 438 | 83 | 0.038 |
| Comparative Example 7 | 1.13 | 0.37 | 1.81 | 0.44 | 514 | 34 | 432 | 84 | 0.034 |
| Comparative Example 8 | 6.12 | 0.28 | 1.73 | 0.82 | 683 | 38 | 560 | 82 | 0.039 |
| Comparative Example 9 | 1.29 | 0.39 | 1.87 | 0.91 | 627 | 35 | 502 | 80 | 0.032 |

From the above-described results, it is found that the Cu—Ni—Si-based copper alloy sheet of the invention of the example has excellent mold abrasion resistance and shear workability while maintaining tensile strength and conductivity.

Thus far, the manufacturing method of the embodiment of the invention has been described, but the invention is not limited thereto, and a variety of modifications can be added within the scope of the purpose of the invention.

INDUSTRIAL APPLICABILITY

The Cu—Ni—Si-based copper alloy sheet of the invention having excellent mold abrasion resistance and shear workability can be used as a conductive member such as a connector for vehicle electric connection or a connection terminal for a print substrate.

The invention claimed is:

1. A Cu—Ni—Si-based copper alloy sheet, comprising:

1. 0 mass % to 4.0 mass % of Ni; and 0.2 mass % to 0.9 mass % of Si, with a remainder made up of Cu and inevitable impurities, wherein the Cu—Ni—Si-based copper alloy sheet has a surface and a surface layer which represents a portion of the sheet that is as thick as 20% of the entire sheet thickness measured from the surface of the sheet;

the number of Ni—Si precipitate particles having a grain diameter in a range of 20 nm to 80nm on the surface is in a range of $1.5\times10^6$ particles/mm$^2$ to $5.0\times10^6$ particles/mm$^2$;

the number of Ni—Si precipitate particles having a grain diameter of greater than 100 nm on the surface is in a range of $0.5\times10^5$ particles/mm$^2$ to $4.0\times10^5$ particles/mm$^2$;

the number of the Ni—Si precipitate particles/mm$^2$ having a grain diameter in a range of 20nm to 80 nm in the surface layer is represented by "a";

the number of the Ni—Si precipitate particles/mm$^2$ having a grain diameter in a range of 20nm to 80 nm in an interior portion of the surface layer is represented by "b";

the ratio of a/b is in a range of 0.5 to 1.5; and the concentration of Si forming a solid solution in crystal grains in an area that is less than 10 μm thickness from the surface is in a range of 0.03 mass % to 0.4 mass %.

2. The Cu—Ni—Si-based copper alloy sheet according to claim 1, further comprising:

0.2 mass % to 0.8 mass % of Sn; and 0.3 mass % to 1.5 mass % of Zn.

3. The Cu—Ni—Si-based copper alloy sheet according to claim 1, further comprising:

0.001 mass % to 0.2 mass % of Mg.

4. The Cu—Ni—Si-based copper alloy sheet according to claim 1, further comprising one or more of:

0.007 mass % to 0.25 mass % of Fe;

0.001 mass % to 0.2 mass % of P;

0.0001 mass % to 0.001 mass % of C;

0.001 mass % to 0.3 mass % of Cr; and 0.001 mass % to 0.3 mass % of Zr.

5. The Cu—Ni—Si-based copper alloy sheet according to claim 3, further comprising one or more of:

0.007 mass % to 0.25 mass % of Fe;

0.001 mass % to 0.2 mass % of P;

0.0001 mass % to 0.001 mass % of C;

0.001 mass % to 0.3 mass % of Cr; and 0.001 mass % to 0.3 mass % of Zr.

6. A method for manufacturing the Cu—Ni—Si-based copper alloy sheet according to claim 1, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

7. A method for manufacturing the Cu—Ni—Si-based copper alloy sheet according to claim 3, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

8. A method for manufacturing the Cu—Ni—Si-based copper alloy sheet according to claim 4, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

9. A method for manufacturing the Cu—Ni—Si-based copper alloy sheet according to claim 5, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

10. The Cu—Ni—Si-based copper alloy sheet according to claim 2, further comprising:

0.001 mass % to 0.2 mass % of Mg.

11. The Cu—Ni—Si-based copper alloy sheet according to claim 2, further comprising one or more of:

0.007 mass % to 0.25 mass% of Fe;

0.001 mass % to 0.2 mass % of P;

0.0001 mass % to 0.001 mass % of C;

0.001 mass % to 0.3 mass % of Cr; and 0.001 mass % to 0.3 mass % of Zr.

12. The Cu—Ni—Si-based copper alloy sheet according to claim 10, further comprising one or more of:

0.007 mass % to 0.25 mass % of Fe;

0.001 mass % to 0.2 mass % of P;

0.0001 mass % to 0.001 mass % of C;

0.001 mass % to 0.3 mass % of Cr; and 0.001 mass % to 0.3 mass % of Zr.

13. A method for manufacturing the Cu—Ni—Si-based copper alloy sheet according to claim 2, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

14. A method for manufacturing the Cu—Ni—Si-based copper alloy sheet according to claim 10, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

15. A method for manufacturing the Cu—Ni—Si-based copper alloy sheet according to claim 11, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

16. A method for manufacturing the Cu—Ni—Si-based copper alloy sheet according to claim 12, wherein, when the Cu—Ni—Si-based copper alloy sheet is manufactured using a process including hot rolling, cold rolling, a solution treatment, an aging treatment, final cold rolling, and stress-relieving annealing in this order, cooling is carried out with a cooling start temperature after the end of the final pass of the hot rolling in a range of 350° C. to 450° C., the cold rolling before the solution treatment is carried out with an average rolling reduction per pass in a range of 15% to 30% and a total rolling reduction of 70% or more, the solution treatment is carried out at a temperature in a range of 800° C. to 900° C. for 60 seconds to 120 seconds, and the aging treatment is carried out at a temperature in a range of 400° C. to 500° C. for 7 hours to 14 hours.

* * * * *